US007498089B2

(12) United States Patent
Omori et al.

(10) Patent No.: US 7,498,089 B2
(45) Date of Patent: Mar. 3, 2009

(54) COATED CUTTING TOOL HAVING COATING FILM ON BASE

(75) Inventors: Naoya Omori, Itami (JP); Shinya Imamura, Itami (JP); Hideki Moriguchi, Itami (JP); Haruyo Fukui, Itami (JP); Makoto Setoyama, Itami (JP)

(73) Assignee: Sumitomo Electric Hardmetal Corp., Hyogo (JP)

( * ) Notice: Subject to any disclaimer, the term of this patent is extended or adjusted under 35 U.S.C. 154(b) by 214 days.

(21) Appl. No.: 10/597,503

(22) PCT Filed: Sep. 6, 2005

(86) PCT No.: PCT/JP2005/016286

§ 371 (c)(1),
(2), (4) Date: Jul. 27, 2006

(87) PCT Pub. No.: WO2006/030663

PCT Pub. Date: Mar. 23, 2006

(65) Prior Publication Data

US 2007/0172675 A1 Jul. 26, 2007

(30) Foreign Application Priority Data

Sep. 17, 2004 (JP) ..... 2004-271976

(51) Int. Cl.
*C23C 16/30* (2006.01)

(52) U.S. Cl. ..... 428/697; 51/307; 51/309; 428/336; 428/698; 428/699; 428/701; 428/704

(58) Field of Classification Search ..... 51/307, 51/309; 428/336, 697, 698, 699, 701, 702, 428/704

See application file for complete search history.

(56) References Cited

U.S. PATENT DOCUMENTS

| | | | | | |
|---|---|---|---|---|---|
| 4,717,632 | A | * | 1/1988 | Keem et al. | 428/698 |
| 5,580,653 | A | * | 12/1996 | Tanaka et al. | 428/336 |
| 5,915,162 | A | * | 6/1999 | Uchino et al. | 428/699 |
| 5,985,427 | A | * | 11/1999 | Ueda et al. | 428/699 |
| 6,767,658 | B2 | * | 7/2004 | Yamamoto et al. | 428/697 |
| 6,824,601 | B2 | * | 11/2004 | Yamamoto et al. | 428/698 |

FOREIGN PATENT DOCUMENTS

| | | | |
|---|---|---|---|
| JP | 07-100701 | A | 4/1995 |
| JP | 07-310174 | A | 11/1995 |
| JP | 09-277103 | A | 10/1997 |
| JP | 2793773 | B2 | 9/1998 |
| JP | 2000-326108 | A | 11/2000 |
| JP | 2001-341008 | A | 12/2001 |
| JP | 3347687 | B2 | 11/2002 |
| JP | 2003-034859 | A | 2/2003 |
| JP | 2004-322226 | A | 11/2004 |
| JP | 3719847 | B2 | 11/2005 |

* cited by examiner

*Primary Examiner*—Archene Turner
(74) *Attorney, Agent, or Firm*—Ditthavong Mori & Steiner, P.C.

(57) ABSTRACT

The present invention relates to a coated cutting tool equipped with a substrate and a coating formed on the substrate. The coating includes: a compound formed from elements Al and/or Cr and at least one element selected from a group consisting of carbon, nitrogen, oxygen, and boron; and chlorine.

6 Claims, No Drawings

COATED CUTTING TOOL HAVING COATING FILM ON BASE

CROSS-REFERENCE TO PRIOR APPLICATION

This is a U.S. National Phase Application under 35 U.S.C. §371 of International Patent Application No. PCT/JP2005/016286 filed Sep. 6, 2005, and claims the benefit of Japanese Patent Application No. 2004-271976 filed Sep. 17, 2004, both of which are incorporated by reference herein. The International Application was published in Japanese on Mar. 23, 2006 as WO 2006/030663 A1 under PCT Article 21(2).

TECHNICAL FIELD

The present invention relates to a cutting tool such as a drill, an end mill, an indexable insert for drills, indexable insert for end mills, an indexable insert for milling, an indexable insert for turning, a metal saw, a gear cutting tool, a reamer, or a tap. More specifically, the present invention relates to a coated cutting tool suited for processing steel and cast material wherein a coating is formed on the surface of the tool to improve wear resistance and the like.

BACKGROUND ART

In addition to high speeds, high precision, and high efficiency, recent years have seen an orientation in the field of cutting toward zero-emission cutting and dry cutting. In addition, with progress in industrial technology, there has been growing activity in industries that use new materials and materials that are difficult to cut such as those used in aircraft, space development, nuclear power generation, and the like. It is expected that qualitative diversity and quantitative expansion will continue to take place, clearly requiring cutting technology to adjust to these developments.

In particular, the temperature during cutting of the cutting edge of the tool tends to increase under these conditions, leading to reduced tool life. To overcome this problem, cutting tools need to be provided with improved wear resistance, oxidation resistance, and the like.

In response, various types of coated cutting tools have been proposed and implemented. For example, in one known cutting tool, wear resistance and surface protection is improved by coating the surface of a cutting tool formed from a WC-based cemented carbide, cermet, high-speed steel, or the like or a hard substrate of a wear-resistant tool or the like. For the coating, an AlTiSi-based film is used as a hard coating layer (e.g., $(Al_xTi_{1-x-y}Si_y)(N_zC_{1-z})$, where $0.05 \leqq x \leqq 0.75$, $0.01 \leqq y \leqq 0.1$, and $0.6 \leqq z \leqq 1$). (Japanese Patent Publication Number 2793773, (Japanese Unexamined Patent Publication Number Hei 07-310174, Patent Document 1)). However, it has not been possible to adequately meet the demands for the advanced characteristics described above with cutting tools of this type.

In another proposed technology, a nitride, carbonitride, oxynitride, or carbo-oxynitride having Ti as its main component and containing an appropriate amount of Si is interleaved with a nitride, carbonitride, oxynitride, or carbo-oxynitride having Ti and Al as its main components, there being at least one layer of each. The layers are disposed so that, in the microstructure of the former, independent phases of Si3N4 and Si are present as independent phases in the nitride, carbonitride, oxynitride, or carbo-oxynitride having Ti as its main component. Thus performance of the cutting tool during dry, high-speed cutting is significantly improved (Japanese Patent Publication Number 3347687 (Japanese Unexamined Patent Publication Number 2000-326108, Patent Document 2)).

According to this proposal, with a conventional TiAlN film, an alumina layer formed through surface oxidation taking place during cutting acts as an oxidation protection film that prevents the inward diffusion of oxygen. However, in dynamic cutting, the outermost alumina layer can easily peel away from the porous Ti oxide layer directly beneath it, resulting in inadequate prevention of oxidation. In contrast, a TiSi-based coating used in this proposal provides extremely good oxidation resistance for the film itself while the formation on the outermost surface of a very fine Ti and Si compound oxide containing Si prevents the formation of the porous Ti oxide layer that was a problem in the conventional technology, thus further improving performance. Furthermore, in this proposed technology, the forming to the TiSi-based coating directly on the TiAl-based film is considered important, and the sequence of coatings is also defined. However, this type of cutting tool is still unable to adequately meet the demand for advanced characteristics described above.

A cutting tool has been proposed with a hard coating for cutting tools having superior wear resistance than conventional TiAlN films. The coating is a hard coating formed from $(Al_b, [Cr_{1-\alpha}V_{\alpha c})(C_{1-d}N_d)$ (where $0.5 \leqq b \leqq 0.8$, $0.2 \leqq c \leqq 0.5$, $b+c=1$, $0.5 \leqq d \leqq 1$, $0.05 \leqq \alpha \leqq 0.95$) or from $(M_a, Al_b, [Cr_{1-\alpha}V_\alpha]_c)(C_{1-d}N_d)$ (where $0.02 \leqq a \leqq 0.3$, $0.5 \leqq b \leqq 0.8$, $0.05 \leqq c$, $a+b+c=1$, $0.5 \leqq d \leqq 1$, $0 \leqq \alpha \leqq 1$, and M is Ti, Nb, W, Ta, or Mo). (Japanese Unexamined Patent Publication Number 2003-034859 (Patent Document 3)).

In this proposal, out of the metal components, Al has a high content, with Cr and V being added. This makes it possible to form cubic AlN, which is metastable phase at standard temperature and pressure, thus providing superior hardness and oxidation resistance. However, when performing high-speed, high-efficiency cutting or dry cutting without any lubricant, these coatings have inadequate hardness and stability at high temperatures, preventing them from adequately meeting the demands for advanced characteristics described above.

[Patent Document 1] Japanese Patent Publication Number 2793773 (Japanese Unexamined Patent Publication Number Hei 07-310174)

[Patent Document 2] Japanese Patent Publication Number 3347687 (Japanese Unexamined Patent Publication Number 2000-326108)

[Patent Document 3] Japanese Unexamined Patent Publication Number 2003-034859

DISCLOSURE OF INVENTION

The object of the present invention is to overcome these problems and to provide a coated cutting tool that dramatically improves the wear resistance and oxidation resistance of the coating.

The present invention is a coated cutting tool equipped with a substrate and a coating formed on the substrate. The coating includes: a compound formed from elements Al and/or Cr and at least one element selected from a group consisting of carbon, nitrogen, oxygen, and boron; and chlorine.

According to another aspect, the present invention is a coated cutting tool equipped with a substrate and a coating formed on the substrate. The coating includes: a compound formed from elements Al and/or Cr, at least one element selected from a group consisting of a group IVa element, a group Va element, a group VIa element, and Si, and at least one element selected from a group consisting of carbon, nitrogen, oxygen, and boron; and chlorine.

According to another aspect, the present invention is a coated cutting tool equipped with a substrate and a coating formed on the substrate. The coating is formed from at least two coating layers. A first layer of the coating layers contains a compound formed from elements Al and/or Cr and at least one element selected from a group consisting of carbon, nitrogen, oxygen, and boron. A second layer of the coating layers contains a compound formed from: at least one type of element selected from a group consisting of a group IVa element, a group Va element, a group VIa element, and Si; and at least one element selected from a group consisting of carbon, nitrogen, oxygen, and boron. At least one of the coating layers contains chlorine. This coating can also contain a third layer in addition to the first layer and the second layer, with this third layer containing chlorine.

It would be preferable for the coating to have a thickness of 0.05 microns and no more than 20 microns. Also, it would be preferable for the chlorine in the coating to have a concentration of at least 0.0001 percent by mass and no more than 1 percent by mass.

Also, it would be preferable for the coating to have a cubic crystal structure. Also, it would be preferable for the substrate to be a cemented carbide, a cermet, a high-speed steel, a ceramic, a cubic boron nitride sintered body; a diamond sintered body; a silicon nitride sintered body; or a mixture of aluminum oxide and titanium carbide.

Also, it would be preferable for the coated cutting tool of the present invention to be a cutting tool such as a drill, an end mill, an indexable insert for drills, indexable insert for end mills, an indexable insert for milling, an indexable insert for turning, a metal saw, a gear cutting tool, a reamer, or a tap.

In a coated cutting tool according to the present invention as described above, there is a dramatic improvement in the wear resistance and oxidation resistance of the coating, especially because of the presence of chlorine in the coating.

BEST MODE FOR CARRYING OUT THE INVENTION

<Coated Cutting Tool>

The coated cutting tool of the present invention includes a substrate and a coating formed on the substrate. The coating formed on the substrate referred to here is not restricted to a coating formed in direct contact with the substrate but can also include an intermediate layer described later interposed between the substrate and the coating. In the present application, a coating formed on the substrate can include an intermediate layer formed in this manner. It would also be possible for a surface layer described later to be formed on the surface of the coating.

The coated cutting tool of the present invention is suited for use as a cutting tool such as a drill, an end mill, an indexable insert for drills, indexable insert for end mills, an indexable insert for milling, an indexable insert for turning, a metal saw, a gear cutting tool, a reamer, or a tap. More specifically, because the wear resistance and the oxidation resistance of the coating is dramatically improved, the present invention can be used as a coated cutting tool suited for processing steel and cast material.

<Substrate>

The substrate used for the coated cutting tool of the present invention can be any substrate that is well known as a conventional substrate for this type of use. For example, it would be preferable for the substrate to be formed from: a cemented carbide (e.g., a WC-based cemented carbide or a cemented carbide that includes, in addition to WC, Co with the optional addition of a carbonitride such as Ti, Ta, or Nb); cermet (with TiC, TiN, TiCN, or the like as the main component); high-speed steel; ceramic (titanium carbide, silicon carbide, silicon nitride, aluminum nitride, aluminum oxide, or the like); a cubic boron nitride sintered body; a diamond sintered body; a silicon nitride sintered body; or a mixture of aluminum oxide and titanium carbide.

<Coating>

As long as it is formed on the substrate described above, the coating of the present invention does not necessarily need to cover the entire surface of the substrate. It would be possible for there to be sections of the surface of the substrate on which the coating is not formed. If post-processing is performed to remove a section of the coating surface after the coating has been formed, the new layer forming the exposed outermost surface after this removal can also be the coating of the present invention. Also, if an intermediate layer described later is formed between the substrate and the coating, and post-processing is performed to remove a section of the coating so that the intermediate layer is exposed as the outermost layer, then in the present invention the intermediate layer can be the coating at the exposed section.

This coating of the present invention includes: a compound formed from the elements Al and/or Cr and at least one element selected from a group consisting of carbon, nitrogen, oxygen, and boron; and chlorine. (This coating will hereinafter be referred to as a first coating.)

In this coating, oxidation resistance and thermal conductivity are improved because of the presence of a compound containing the element Al and/or Cr. As a result, heat generated during cutting can escape from the coating surface, making it suitable for applications where the coating surface can reach high temperatures.

Also, in the compound formed from the elements Al and/or Cr and at least one element selected from a group consisting of carbon, nitrogen, oxygen, and boron; and chlorine, the presence of at least one element selected from a group consisting of carbon, nitrogen, oxygen, and boron provides increased hardness.

Furthermore, the presence of chlorine provides a dramatic increase in wear resistance. The mechanism by which the presence of chlorine dramatically increases wear resistance is not fully understood yet, but it is believed that the chlorine in the coating improves lubricity between the coating surface and the workpiece. The presence, along with the above compound, of chlorine in the coating as described above includes cases where the chlorine enters the normal position of the crystal lattice of the compound as a substitution element, cases where chlorine enters the normal position of the crystal lattice of the compound as an interstitial element, cases where a chloride is formed, or the like. Regarding the concentration distribution of chlorine in the coating, the superior advantages of the presence of chlorine are provided whether the chlorine is uniformly distributed in the coating, the chlorine is distributed at high concentration or low concentration at crystal grain boundaries, the chlorine is distributed at high concentration or low concentration at the surface of the coating, or the like.

Although the method for forming the coating is not restricted to this, it would be preferable to use chemical vapor deposition (CVD) in which one of the raw materials is chlorine gas and/or a gaseous or evaporated chloride. It would be more preferable to use thermal CVD. By selecting coating forming conditions so that chlorine from the raw gas is included in the coating, it is possible to include chlorine in the coating without degrading the characteristics of the coating itself.

In the coating of the present invention, the characteristics described above work synergistically so that there is a dramatic improvement in wear resistance and oxidation resistance. Examples of the compound contained in this coating formed from the elements Al and/or Cr and at least one element selected from a group consisting of carbon, nitrogen, oxygen, and boron include: AlN, CrN, $Al_{1-x}Cr_xN$, $Al_{1-x}Cr_xCN$ (where x is any number no more than 1), and the like.

According to another aspect, a coating of the present invention includes: a compound formed from the element Al and/or Cr, at least one element selected from a group consisting of a group IVa element (e.g., Ti, Zr, Hf), a group Va element (e.g., V, Nb, Ta), a group VIa element (e.g., Cr, Mo, W), and Si, and at least one element selected from a group consisting of carbon, nitrogen, oxygen, and boron; and chlorine. (This type of coating will be referred to hereinafter as a second coating.)

In addition to the characteristics described above for the first coating, the presence of at least one element selected from a group consisting of a group IVa element (e.g., Ti, Zr, Hf), a group Va element (e.g., V, Nb, Ta), a group VIa element (e.g., Cr, Mo, W), and Si improves adhesion strength with the substrate and provides further improvements in the hardness of the coating, especially at high temperatures.

Examples of the compound formed from the element Al and/or Cr, at least one element selected from a group consisting of a group IVa element (e.g., Ti, Zr, Hf), a group Va element (e.g., V, Nb, Ta), a group VIa element (e.g., Cr, Mo, W), and Si, and at least one element selected from a group consisting of carbon, nitrogen, oxygen, and boron include: $Al_{1-x}Ti_xN$, $Al_{1-x}V_xN$, $Al_{1-x-y}Ti_xSi_yN$, $Al_{1-x-y}Cr_xSi_yN$ (where x and y are numbers no more than 1). The manner in which chlorine is included in the compound and the method for forming the coating are similar to those for the first coating.

Furthermore, the coating of the present invention can include two or more coating layers. In this case, a first layer of the coating layers can include a compound formed from the elements Al and/or Cr and at least one element selected from a group consisting of carbon, nitrogen, oxygen, and boron. A second layer of the coating layers can include a compound formed from the element Al and/or Cr, at least one element selected from a group consisting of a group IVa element, a group Va element, a group VIa element, Al, and Si, and at least one element selected from a group consisting of carbon, nitrogen, oxygen, and boron. At least one of these coating layers includes chlorine. (This type of coating will hereinafter be referred to as a third coating.)

In this type of coating, either the first layer or the second layer can be formed closer toward the substrate, and there are no special restrictions on the sequence of layers.

Both the first layer and the second layer can be formed by stacking a plurality of layers so that the structure is an alternating stack of the first layer and the second layer. It would also be possible for intermediate layers and surface layers described later to be present between the first layer and the second layer.

This type of third coating can include a third layer besides the first layer and the second layer described above, with this third layer containing chlorine. In this case, the presence of chlorine in the first layer or the second layer is not necessary. This third layer can include the intermediate layer and the surface layer described later formed between the first layer and the second layer, the intermediate layer formed between the third coating and the substrate, and the surface layer formed on the third coating. The manner in which chlorine is included in the first layer through the third layer and the method for forming the coatings are similar to those for the first coating.

In addition to the characteristics described above for the first coating and the second coating, the stacking of the first layer and the second layer in the third layer provides further improvements in the adhesion with the substrate due to the action of the second layer, and also provides further improvements in the hardness of the coating, especially at high temperatures. From this perspective, it would be especially preferable for the second layer to contain TiN, TiCN, TiAlN, or the like. For examples for the compound in the first layer, examples similar to the ones described for the first coating can be used.

In terms of chemical stability, it would be preferable for the first coating through the third coating described above to be formed using a film forming process that can form compounds with a high degree of crystallinity. Suitable examples include CVD (chemical vapor deposition), described above, physical vapor deposition (PVD), and combinations of these methods with ion implantation. Other methods include sputtering and vacuum deposition.

Also, it would be preferable for each of the coatings described above to have a thickness of at least 0.05 microns and no more than 20 microns (total thickness of layers if a coating is formed from multiple layers). If the thickness is less than 0.05 microns, the wear resistance may not be adequately improved. If the thickness exceeds 20 microns, the residual stress of the coating itself increases so that the adhesion strength with the substrate may be reduced. Thus, it would be more preferable for the thickness of these coatings to have an upper limit of 15 microns and a lower limit of 0.5 microns, even more preferably 1 micron. The thickness of these coatings can be measured, for example, by cutting the coated cutting tool and observing the cross-section under an SEM (scanning electron microscope).

Also, it would be preferable for these coatings to have a cubic crystal structure. This provides superior chemical stability at high temperatures.

Also, it would be preferable for the chlorine concentration in the coating to be at least 0.0001 percent by mass and no more than 1 percent by mass. If the concentration is less than 0.0001 percent by mass, the advantages provided by chlorine content described above may not be adequately manifested. If the concentration exceeds 1 percent by mass, the hardness of the coating may be reduced. Thus, it would be more preferable for the chlorine concentration to have an upper limit of 0.1 percent by mass, more preferably 0.03 percent by mass, and a lower limit of 0.001 percent by mass. This type of chlorine concentration can be measured using XPS (X-ray photoelectron spectroscopy), SIMS (secondary ion mass spectrometry), ICP (inductively coupled plasma spectroscopy), and the like.

If a coating is formed from a plurality of coating layers, the chlorine concentration in the coating layer containing the chlorine has the chlorine concentration range described above.

<Intermediate Layers and Surface Layers>

In the coated cutting tool of the present invention, an intermediate layer can be formed between the substrate and the coating. This type of intermediate layer can generally improve wear resistance, improve adhesion between the substrate and the coating, and the like, and can be formed from one layer or a plurality of layers.

This type of intermediate layer can be formed, e.g., from $Al_2O_3$, TiCN, TiAlN, or CrAlN. Examples of methods for forming the layer include CVD, PVD, sputtering, and vacuum vapor deposition.

Also, in the coated cutting tool of the present invention, a surface layer can be formed on the surface of a coating. This type of surface layer can generally improve wear resistance and oxidation resistance and can be formed from one layer or a plurality of layers.

This type of surface layer can be formed, e.g., from $Al_2O_3$, TiN, or AlN. Examples of methods for forming the layer include CVD, PVD, sputtering, and vacuum vapor deposition.

The present invention will be described in further detail below using examples, but the present invention is not restricted to these examples.

EXAMPLES 1-28 AND COMPARATIVE SAMPLES 1-4

First, a WC powder with a mean particle diameter of 2.6 microns (hereinafter referred to as raw powder A), a (Ti, W)C powder with a mean particle diameter of 1.3 microns (proportion by mass: TiC/WC=30/70, hereinafter referred to as raw powder B), a TaNbC powder with a mean particle diameter of 1.0 microns (proportion by mass: TaC/NbC=2/1, hereinafter referred to as raw powder C), and a Co powder with a mean particle diameter of 1.3 microns (hereinafter referred to as raw powder D) were prepared.

Next, a mixture was prepared using 4.0 percent by mass of raw powder B, 3.0 percent by mass of raw powder C, 8.0 percent by mass of raw powder D, with the remainder being raw powder A to achieve 100 percent by mass. A ball mill was used to perform wet mixing for 72 hours.

Next, after drying, the mixture was pressed at a pressure of 1.0 t/cm$^2$, and the shaped body was sintered for one hour at 1420 deg C. After sintering, circular honing was performed at R0.05 on the blade (cutting edge) using barrel finishing. This resulted in an ISO/SNGN120408 WC-based cemented carbide cutting insert, which was used as the substrate.

The coatings shown in Table 1 and Table 2 (compositions indicated as atomic ratios) were formed using a standard procedure involving chemical vapor deposition (CVD) or physical vapor deposition (PVD). This resulted in the coated cutting tool of the present invention. Except for Example 28, the coatings on the coated cutting tools obtained in this manner all had cubic crystal structures (all the comparative samples described below also had cubic crystal structures, but Example 28 had a rhombic structure).

Then, the chlorine content in the coatings was measured using the SIMS method. In Table 1 and Table 2, the "-" notation in the chlorine content column indicates that the chlorine content was outside the range of detection of the SIMS method.

TABLE 1

| | | Coating | | | | | | |
|---|---|---|---|---|---|---|---|---|
| | | First Layer | | | Second Layer | | | |
| | | Composition | Thickness (μm) | Chlorine (PPM) | Composition | Thickness (μm) | Chlorine (PPM) | Third Layer Composition |
| Examples | 1 | AlN | 2.7 | 24 | | | | |
| | 2 | CrN | 2.6 | 37 | | | | |
| | 3 | $(Al_{0.71}Ti_{0.29})N$ | 1.3 | 24 | | | | |
| | 4 | $(Al_{0.65}Cr_{0.35})CN$ | 2.6 | 37 | | | | |
| | 5 | $(Al_{0.71}Cr_{0.29})N$ | 2.7 | 52 | | | | |
| | 6 | $(Al_{0.71}Cr_{0.29})N$ | 18.6 | 68 | | | | |
| | 7 | $(Al_{0.71}Cr_{0.29})N$ | 2.8 | 8206 | | | | |
| | 8 | $(Al_{0.71}Cr_{0.29})N$ | 2.6 | 1 | | | | |
| | 9 | $(Al_{0.71}Cr_{0.29})N$ | 2.7 | 52 | $(Al_{0.65}Ti_{0.29}Si_{0.06})CN$ | 0.2 | 25 | |
| | 10 | $(Al_{0.71}V_{0.29})N$ | 2.0 | 8 | | | | |
| | 11 | $(Al_{0.64}Cr_{0.26}V_{0.1})N$ | 1.8 | 44 | | | | |
| | 12 | $(Al_{0.65}Cr_{0.30}Si_{0.05})N$ | 2.4 | 68 | | | | |
| | 13 | $(Al_{0.65}Ti_{0.29}Si_{0.06})N$ | 3.1 | 61 | | | | |
| | 14 | TiN | 0.19 | 34 | $(Al_{0.71}Cr_{0.29})N$ | 1.9 | — | |
| | 15 | TiN | 0.19 | 125 | $(Al_{0.65}Cr_{0.35})CN$ | 2.3 | 18 | |
| | 16 | TiN | 0.19 | 68 | $(Al_{0.71}Cr_{0.29})N$ | 1.8 | — | $(Al_{0.65}Ti_{0.29}Si_{0.06})N$ |
| | 17 | TiN | 0.19 | 5 | $(Al_{0.71}Cr_{0.29})N$ | 1.9 | — | |
| | 18 | TiCN | 0.25 | 48 | $(Al_{0.71}Cr_{0.29})N$ | 3.1 | — | |
| | 19 | TiCN | 0.21 | 41 | $(Al_{0.64}Cr_{0.36})CN$ | 2.9 | 35 | |
| | 20 | TiCN | 0.18 | 55 | $(Al_{0.68}Cr_{0.32})CN$ | 3.2 | 72 | $Al_2O_3$ |

| | | Coating | | | | | Flank face wear (mm) | |
|---|---|---|---|---|---|---|---|---|
| | | Third Layer | | Fourth Layer | | | | |
| | | Thickness (μm) | Chlorine (PPM) | Composition | Thickness (μm) | Chlorine (PPM) | Continuous cutting | Intermittent cutting |
| Examples | 1 | | | | | | 0.112 | 0.108 |
| | 2 | | | | | | 0.151 | 0.165 |
| | 3 | | | | | | 0.081 | 0.079 |
| | 4 | | | | | | 0.093 | 0.081 |
| | 5 | | | | | | 0.084 | 0.079 |
| | 6 | | | | | | 0.071 | 0.076 |
| | 7 | | | | | | 0.079 | 0.081 |
| | 8 | | | | | | 0.081 | 0.083 |
| | 9 | | | | | | 0.059 | 0.070 |
| | 10 | | | | | | 0.084 | 0.081 |
| | 11 | | | | | | 0.079 | 0.084 |
| | 12 | | | | | | 0.081 | 0.078 |

TABLE 1-continued

| | | | | |
|---|---|---|---|---|
| 13 | | | 0.084 | 0.077 |
| 14 | | | 0.068 | 0.075 |
| 15 | | | 0.071 | 0.068 |
| 16 | 0.2 | — | 0.065 | 0.076 |
| 17 | | | 0.058 | 0.068 |
| 18 | | | 0.071 | 0.057 |
| 19 | | | 0.081 | 0.071 |
| 20 | 1.3 | 11 | 0.045 | 0.054 |

TABLE 2

| | | Coating | | | | | | |
|---|---|---|---|---|---|---|---|---|
| | | First Layer | | | Second Layer | | | |
| | | Composition | Thickness (μm) | Chlorine (PPM) | Composition | Thickness (μm) | Chlorine (PPM) | Third Layer Composition |
| Examples | 21 | TiN | 0.19 | 39 | $(Al_{0.69}Cr_{0.31})CN$ | 2.8 | 52 | $Al_2O_3$ |
| | 22 | $(Al_{0.69}Cr_{0.31})CN$ | 2.8 | 52 | $Al_2O_3$ | 1.3 | 21 | TiN |
| | 23 | $(Al_{0.71}Ti_{0.29})N$ | 1.2 | — | $(Al_{0.71}Cr_{0.29})N$ | 2.7 | — | $Al_2O_3$ |
| | 24 | TiN | 0.11 | 28 | TiCN | 1.2 | 68 | $(Al_{0.71}Cr_{0.29})N$ |
| | 25 | TiN | 0.18 | 34 | TiCN | 2.8 | 58 | $Al_2O_3$ |
| | 26 | TiN | 0.17 | 38 | TiCN | 3.1 | 61 | $Al_2O_3$ |
| | 27 | $(Al_{0.71}Cr_{0.29})N$ | 2.7 | 52 | AlN | 0.2 | — | |
| | 28 | $(Al_{0.76}Ti_{0.24})N$ | 2.5 | 32 | | | | |
| Comparative Samples | 1 | $(Al_{0.65}Cr_{0.35})N$ | 2.6 | — | | | | |
| | 2 | AlN | 2.7 | — | | | | |
| | 3 | CrN | 2.6 | — | | | | |
| | 4 | TiN | 0.19 | — | $(Al_{0.65}Cr_{0.35})CN$ | 2.3 | — | |

| | | Coating | | | | | Flank face wear (mm) | |
|---|---|---|---|---|---|---|---|---|
| | | Third Layer | | Fourth Layer | | | | |
| | | Thickness (μm) | Chlorine (PPM) | Composition | Thickness (μm) | Chlorine (PPM) | Continuous cutting | Intermittent cutting |
| Examples | 21 | 1.3 | 21 | TiN | 0.2 | 16 | 0.062 | 0.061 |
| | 22 | 0.2 | 16 | | | | 0.051 | 0.049 |
| | 23 | 1.1 | 18 | | | | 0.049 | 0.058 |
| | 24 | 2.1 | — | | | | 0.079 | 0.081 |
| | 25 | 1.4 | 11 | AlN | 0.2 | 43 | 0.051 | 0.060 |
| | 26 | 1.5 | 10 | CrN | 0.3 | 38 | 0.049 | 0.053 |
| | 27 | | | | | | 0.079 | 0.077 |
| | 28 | | | | | | 0.188 | 0.192 |
| Comparative Samples | 1 | | | | | | 0.301 | 0.314 |
| | 2 | | | | | | 0.452 | 0.391 |
| | 3 | | | | | | 0.448 | 0.485 |
| | 4 | | | | | | 0.301 | 0.298 |

In Table 1 and Table 2, if the coating includes a second layer through a fourth layer in addition to the first layer, the first layer side is formed toward the substrate surface.

For Comparative Sample 1 through Comparative Sample 4, coated cutting tools were prepared in a similar manner with no chlorine in the coating, as shown in Table 2.

Using the coated cutting tools of the examples and the coated cutting tools of the comparative samples, continuous cutting tests and intermittent cutting tests were performed using the following conditions. The results are indicated as flank face wear in Table 1 and Table 2. Lower flank face wear indicates greater wear resistance.

<Continuous Cutting Test Conditions>

Workpiece: SCM435

Cutting speed: 340 m/min

Feed: 0.30 mm/rev.

Depth of cut: 2.0 mm

Cutting oil: not used

Cutting time: 30 minutes

<Intermittent Cutting Test Conditions>

Workpiece: SCM435

Cutting speed: 300 m/min

Feed: 0.30 mm/rev.

Depth of cut: 1.5 mm

Cutting oil: not used

Cutting time: 40 minutes

As Table 1 and Table 2 shows clearly, Example 1 through Example 28 all provided superior wear resistance compared to Comparative Sample 1 through Comparative Sample 4, indicating that this superior wear resistance is the result of chlorine being present in the coating.

EXAMPLE 29 THROUGH EXAMPLE 34 AND COMPARATIVE SAMPLE 5 THROUGH COMPARATIVE SAMPLE 8

Using a drill (JISK10 cemented carbide) having an outer diameter of 8 mm as a substrate, a coating as shown in Table 3 was formed on the substrate to make a coated cutting tool (drill) according to the present invention. Similarly, coated cutting tools with no chlorine in the coating were made as shown in Table 3 to serve as comparative samples.

Then, using the coated cutting tool examples and coated cutting tool comparative samples prepared in this manner, boring tests were conducted to evaluate tool life using SCM440 (HRC30) as the workpiece. The cutting conditions were: 80 m/min cutting speed; 0.22 mm/rev. feed; no cutting oil (air blower was used); and blind holes 26 mm deep. Tool life was evaluated by defining the end of tool life as being when the dimensional accuracy of the workpiece exceeds a defined range. The results from the tool life evaluations are shown in Table 3. A higher number of cuts (holes) indicates longer tool life.

TABLE 3

| No. | Coating | Number of cuts (holes) |
|---|---|---|
| Example 29 | Same as Example 4 | 7200 |
| Example 30 | Same as Example 5 | 6800 |
| Example 31 | Same as Example 6 | 10020 |
| Example 32 | Same as Example 9 | 14080 |
| Example 33 | Same as Example 15 | 12160 |
| Example 34 | Same as Example 25 | 16830 |
| Comparative sample 5 | Same as Comparative sample 1 | 1500 |
| Comparative sample 6 | Same as Comparative sample 2 | 1800 |
| Comparative sample 7 | Same as Comparative sample 3 | 1900 |
| Comparative sample 8 | Same as Comparative sample 4 | 2400 |

As Table 3 shows, Example 29 through Example 34 all provided longer tool life compared to the Comparative Sample 5 through Comparative Sample 8, indicating superior oxidation resistance. This indicates that the superior oxidation resistance is the result of the presence of chlorine in the coating.

EXAMPLE 35 THROUGH EXAMPLE 40 AND COMPARATIVE SAMPLE 9 THROUGH COMPARATIVE SAMPLE 12

Using a six-blade end mill (JISK10 cemented carbide) having an outer diameter of 8 mm as a substrate, a coating as shown in Table 4 was formed on the substrate to make a coated cutting tool (end mill) according to the present invention. Similarly, coated cutting tools with no chlorine in the coating were made as shown in Table 4 to serve as comparative samples.

Then, using the coated cutting tool examples and coated cutting tool comparative samples prepared in this manner, side milling tests were conducted to evaluate tool life using SKD11 (HRC60) as the workpiece. The cutting conditions were: 220 m/min cutting speed; 0.028 mm/blade feed; no cutting oil (air blower was used); and Ad=12 mm Rd=0.2 mm depth of cut. Tool life was evaluated by defining the end of tool life as being when the dimensional accuracy of the workpiece exceeds a defined range. The results from the tool life evaluations are shown in Table 4. A longer cutting length (m) for when dimensional accuracy exceeds the range indicates longer tool life.

TABLE 4

| No. | Coating | Length of cut when dimensional accuracy range is exceeded (m) |
|---|---|---|
| Example 35 | Same as Example 4 | 680 |
| Example 36 | Same as Example 5 | 710 |
| Example 37 | Same as Example 6 | 1130 |
| Example 38 | Same as Example 9 | 1205 |
| Example 39 | Same as Example 15 | 1335 |
| Example 40 | Same as Example 25 | 1469 |
| Comparative sample 9 | Same as Comparative sample 1 | 12 |
| Comparative sample 10 | Same as Comparative sample 2 | 15 |
| Comparative sample 11 | Same as Comparative sample 3 | 21 |
| Comparative sample 12 | Same as Comparative sample 4 | 24 |

As Table 4 shows, Example 35 through Example 40 all provided longer tool life compared to Comparative Sample 9 through Comparative Sample 12, indicating superior oxidation resistance. This indicates that superior oxidation resistance is provided by the presence of chlorine in the coating.

EXAMPLE 41 THROUGH EXAMPLE 46 AND COMPARATIVE SAMPLE 13 THROUGH COMPARATIVE SAMPLE 16

First, a cemented carbide pot and ball were used to mix a binder powder formed from 42 percent by mass of TiN and 10 percent by mass of Al with 48 percent by mass of a cubic boron nitride powder having a mean particle diameter of 2.5 microns. The mixture was then used to fill a cemented carbide container. This was then sintered for 60 minutes at a temperature of 1400 deg C and a pressure of 5 GPa. This results in a cubic boron nitride sintered body in the form of a cutting insert shaped according to ISO SNGN120408. This was used as the substrate.

The coatings indicated in Table 5 were formed on the substrate surfaces, resulting in coated cutting tools (cutting inserts) according to the present invention. Similarly, coated cutting tools with no chlorine in the coating were made as shown in Table 5 to serve as comparative samples.

Then, using the coated cutting tool examples and coated cutting tool comparative samples prepared in this manner, outer perimeter cutting operations were conducted to evaluate tool life using SCM415 rods (HRC62) as the workpiece. The cutting conditions were: 180 m/min cutting speed; 0.07 mm/rev. feed; 0.1 mm cutting depth; and dry cutting. The initial surface roughness Rz is defined as the surface roughness of the workpiece after 1 minute of cutting, and the endurance of the coating was evaluated based on the cutting time required for the surface roughness Rz of the workpiece to reach 3.2 microns. The Rz referred to here indicates a 10-point average roughness as defined by JIS B0601. The results are shown in Table 5. Longer cutting times required for the surface roughness Rz to reach 3.2 microns indicate superior endurance.

TABLE 5

| No. | Coating | Initial surface roughness Rz (μm) | Cutting time when surface roughness Rz of workpiece reaches 3.2 μm (min) |
|---|---|---|---|
| Example 41 | Same as Example 4 | 1.12 | 104 |
| Example 42 | Same as Example 5 | 1.21 | 114 |
| Example 43 | Same as Example 6 | 1.65 | 134 |
| Example 44 | Same as Example 9 | 1.31 | 148 |
| Example 45 | Same as Example 15 | 1.28 | 168 |
| Example 46 | Same as Example 25 | 1.34 | 159 |
| Comparative sample 13 | Same as Comparative sample 1 | 1.21 | 11 |
| Comparative sample 14 | Same as Comparative sample 2 | 1.34 | 9 |
| Comparative sample 15 | Same as Comparative sample 3 | 1.10 | 13 |
| Comparative sample 16 | Same as Comparative sample 4 | 1.34 | 16 |

As Table 5 shows, Example 41 through Example 46 all provided 5 superior endurance compared to the Comparative Sample 13 through Comparative Sample 16, indicating superior oxidation resistance. This indicates that the superior oxidation resistance is the result of the presence of chlorine in the coating.

The embodiments and examples described here are all examples that should not be considered restrictive. The scope of the present invention is indicated not by the above descriptions but by the claims of the invention, and is intended to include the scope of the claims, the scope of equivalences to the claims and all modifications within this scope.

The invention claimed is:

1. A coated cutting tool equipped with a substrate and a coating formed on said substrate, wherein:

said coating is formed from at least two coating layers;

a first layer of said coating layers contains a compound formed from elements Al and Cr and at least one element selected from a group consisting of carbon, nitrogen, oxygen, and boron;

a second layer of said coating layers contains a compound formed from: at least one element selected from a group consisting of a group IVa element, a group Va element, a group VIa element, and Si; and at least one element selected from a group consisting of carbon, nitrogen, oxygen, and boron; and at least one of said coating layers contains chlorine, wherein a concentration of said chlorine in said coating is at least 0.0001 percent by mass and no more than 1 percent by mass, and wherein said second layer is formed closer than said first layer toward the substrate.

2. A coated cutting tool according to claim 1 wherein said coating includes a third layer in addition to said first layer and said second layer, said third layer containing chlorine, and wherein said third layer is formed between said first layer and said second layer.

3. A coated cutting tool according to claim 1 wherein a thickness of said coating is at least 0.05 microns and no more than 20 microns.

4. A coated cutting tool according to claim 1 wherein said coating includes a cubic crystal structure.

5. A coated cutting tool according to claim 1 wherein said substrate is a cemented carbide, a cermet, a high-speed steel, a ceramic, a cubic boron nitride sintered body; a diamond sintered body; a silicon nitride sintered body; or a mixture of aluminum oxide and titanium carbide.

6. A coated cutting tool according to claim 1 wherein said coated cutting tool is a drill, an end mill, an indexable insert for drills, indexable insert for end mills, an indexable insert for milling, an indexable insert for turning, a metal saw, a gear cutting tool, a reamer, or a tap.

* * * * *